US006565622B1

(12) United States Patent
Mailhan et al.

(10) Patent No.: US 6,565,622 B1
(45) Date of Patent: May 20, 2003

(54) METHOD FOR DENITRIDING MOLTEN STEEL DURING ITS PRODUCTION

(75) Inventors: Jean-Christophe Mailhan, Longeville-les-Metz (FR); Daniel Pernet, Metz (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/857,361

(22) PCT Filed: Dec. 17, 1999

(86) PCT No.: PCT/FR99/03176

§ 371 (c)(1),
(2), (4) Date: Jul. 17, 2001

(87) PCT Pub. No.: WO00/37688

PCT Pub. Date: Jun. 29, 2000

(30) Foreign Application Priority Data

Dec. 18, 1998 (FR) ..... 98/16082

(51) Int. Cl.[7] ..... C21C 7/072
(52) U.S. Cl. ..... 75/548; 75/10.42
(58) Field of Search ..... 75/532, 561, 548, 75/551–558, 10.39, 10.42, 10.61, 10.6

(56) References Cited

U.S. PATENT DOCUMENTS 4,514,219 A * 4/1985 de Saint Martin ..... 75/10.22
5,385,599 A 1/1995 Freissmuth
5,562,753 A * 10/1996 de Lassat de Pressigny et al. ..... 373/78

FOREIGN PATENT DOCUMENTS

WO WO 99/20802 4/1999

OTHER PUBLICATIONS

English Translation of JP 63–206421 by Harajima et al, published Aug. 25, 1998.*
Patent Abstracts of Japan; Publication No. 11012634, Jan. 19, 1999, Hideaki.
Patent Abstracts of Japan, Publication No. 632064421, Aug. 25, 1988, Katsutoshi.
Patent Abstracts of Japan, Publication No. 07026318, Jan. 27, 1995, Seiji.
Patent Abstract of Japan, Publication No. 09165615, Jun. 24, 1997, Hideaki.

* cited by examiner

*Primary Examiner*—Roy King
*Assistant Examiner*—Tima Banks

(57) ABSTRACT

The invention concerns a method which consists in injecting into a molten metal bath to be treated, jointly but separately into the same bath zone, oxygen and carbon in a form capable of being blown (powder carbon preferably) so as to generate locally in the bath CO bubbles from those two elements, which will then be loaded in denitriding nitrogen. A stoichiometric adjustment of the carbon and oxygen inputs enable a constant carbon denitriding in the bath. The method is preferably applicable to the production of low-carbon steel grades, in particular in an electric oven.

4 Claims, 1 Drawing Sheet

METHOD FOR DENITRIDING MOLTEN STEEL DURING ITS PRODUCTION

The present invention relates to the domain of the production of low-nitrogen steels. It is advantageously applied to the production of low and very low-carbon grades.

It is known that the presence of nitrogen in steel can prove undesirable for different reasons. One of them is the impact of this element on the properties of use of the steels, further to a reduction in the ductility of the metal and therefore in its aptitude to stamping, or, if the nitrogen is present in the form of aluminium nitrides, further to a limitation of the weldability due to a redissolution of the nitrogen in the ZAC (heat-affected zone) and the resultant local mechanical fragilization. However, the presence of nitrogen can also be undesirable by reason of its impact on the very steps of the production procedures, such as an increase in the cracks linked with the ductility pocket at continuous casting, or the reduction in the aptitude of the product obtained to be wire-drawn.

The processes of production, or the grade of certain steels, therefore sometimes require very low nitrogen contents on the final product obtained, for example, to give an idea, from 15 to 25 ppm for sheets intended for automobile construction or for steels for packing, of about 50 ppm for offshore platform plates, or from 40 to 60 ppm for tyre-reinforcing wires, etc. . . . These nitrogen contents are expected in the steelworks, at all stages of production of the molten metal, from the electric oven, or from the converter, up to its solidification at continuous casting. It is known that the production in the electric oven, in particular, is distinguished by a considerable contamination of the metal with nitrogen, due to the cracking of the molecule of nitrogen of the air in the heat zone of the electric arc which facilitates its transfer to the liquid metal. This phenomenon is known to be an important factor which prevents production by the "electrical procedure" of a part of the grades produced today by the "casting procedure" (reduction-melting of the molten iron ores in the blast furnace then refining with oxygen in a pneumatic converter) by which lower nitrogen contents, of the order of 20 ppm, are currently obtained.

The physico-chemical mechanisms which govern the evolution of the nitrogen content in liquid steel are well known (cf. for example the article by Ch. Gatellier and H. Gaye in the REVUE de METALLURGIE, CIT of January 1986, pp 25–42). The nitrogen follows a "metal-gas" chemical equilibrium which may be expressed by the formula $N \leftrightarrows \frac{1}{2} N_2(gas)$. The constant of equilibrium of this reaction, which is written $K_N = a_N/(P_{N2})^{1/2}$, depends slightly on the temperature in the operational domain of the reactors concerned (1550 to 1700° C.). $a_N$ is the activity in dissolved nitrogen, which may be assimilated to the nitrogen content of the metal in the case of the weakly alloyed carbon steels, and $P_{N2}$ is the partial nitrogen pressure of the gas in contact with the liquid metal. This means that, in the presence of atmospheric $N_2$, the nitrogen content of the metal will continually increase towards its limit of solubility, which lies in the neighbourhood of 430 ppm at the temperature of the molten steel (about 1600° C.).

As for the denitriding of the metal, it is obtained by circulating in the liquid metal a washing gas not comprising nitrogen ($P_{N2}$=O) in order to displace the afore-mentioned reaction towards the right (washing effect). Industrially, this gas may be injected argon or helium, but at low flowrate and with a high cost, or carbon monoxide formed in situ by the decarburization of the metal during the injection of oxygen, which is conventionally practised in gaseous or particulate form (cf. for example the article by K. Shinme and T. Matsuo: "Acceleration of nitrogen removal with decarburization by powdered oxidizer blowing under reduced pressure", in the Japanese Journal ISIJ in 1987). The limit to this practice of injection of $O_2$ is linked with the carbon content of the metal at the beginning of decarburization, which will impose the volume of CO emitted in the course of time and therefore the possible denitriding, and this whatever the initial and envisaged nitrogen contents of the metal to be produced.

This physico-chemical approach must be completed by the role performed by the surface-active elements of the metal, namely oxygen and sulphur, which both have the effect of blocking the transfers of nitrogen between metal and gas. Consequently, beyond a certain activity in dissolved oxygen, corresponding to an upper limit of the carbon content which is of the order of 0.1% by weight for carbon steels), the denitriding by washing gas may be totally inhibited.

All the interest in being able to develop a technique of denitriding of the liquid metal, making it possible in particular to produce by the "electrical" procedure steels whose nitrogen contents are similar to those obtained by the "casting" procedure, i.e. of the order of 20 ppm, and even less on the final product obtained, is thus understood.

The purpose of the present invention is precisely to promote a denitriding of the molten metal which best exploits the denitriding potential of the washing gas, on the one hand, and which, on the other hand, makes it possible to control the final nitrogen content independently of the initial carbon content of the metal bath, while this is presently the case with a conventional decarburization.

To that end, the invention has for its object a method for denitriding molten steel during its production by blowing oxygen, characterized in that it consists in likewise introducing carbon in a form capable of being blown (powder carbon), and in that carbon and oxygen are injected jointly but separately into the same metal bath zone (at some 20 cm distance from each other, for example).

In the carbon and oxygen input zone, conditions favourable to denitriding are thus locally created. In effect, in the case of a simple injection of oxygen (case of conventional decarburization), the injection zone (nozzle) will be translated rapidly by an impoverishment of carbon which will delay the formation of CO, and by a correlatively high activity in dissolved oxygen which, as is known, will act against the denitriding of the metal by the CO bubbles formed.

The combined input of carbon in this same zone will allow a more rapid formation of the CO bubbles by reaction between carbon and oxygen introduced, and a reduction of the local activity in dissolved oxygen. Consequently, there is obtained a better efficiency of the denitriding by the CO emitted , which will thus supplant the natural tendency of the steel to be nitrided upon contact with the nitrogen of the surface air and therefore lead overall to a reduction of the nitrogen content of the metal.

In effect, it is recalled that, in an arc furnace, like, moreover, in any metallurgical reactor which composes the procedure for producing the metal, the enclosure is not and cannot be strictly tight with respect to the outside atmosphere. Consequently, the final nitrogen content of the product obtained necessarily results from a compromise between the nitrogen regains (contamination by the air, for example) and the denitriding carried out during production in the liquid state.

Furthermore, by preferably adjusting the inputs stoichiometrically (namely 1 kg of C for 0.9 Nm3 of $O_2$), the carbon content of the metal bath is not modified. In this way, an emission of CO with "constant carbon content of the bath" is thus effected, and whose duration may then be adapted to the desired denitriding (nitrogen content envisaged with respect to the initial nitrogen content).

BRIEF DESCRIPTION OF THE DRAWINGS

The invention will be readily understood, and other aspects and advantages will appear on reading the following description given with reference to the accompanying sheets of drawings, in which.

The technique of co-injection according to the invention was tested and carried out under industrial conditions in a small oven with a capacity of 6 tons, by simultaneously introducing carbon and oxygen via two independent injection nozzles whose outlet ends were placed side by side at the same level in the bath of molten steel to be treated, at about twenty centimeters from each other. Input of carbon was effected by coal with low sulphur and nitrogen contents (contents by weight less than 0.1% for these two elements), and by using either argon or nitrogen as supporting gas. Oxygen was introduced either by injection of gaseous $O_2$ or by injection of iron ore (equivalent of 0.2 $Nm_3$ of $O_2$ for 1 kg of ore).

Figure 1:
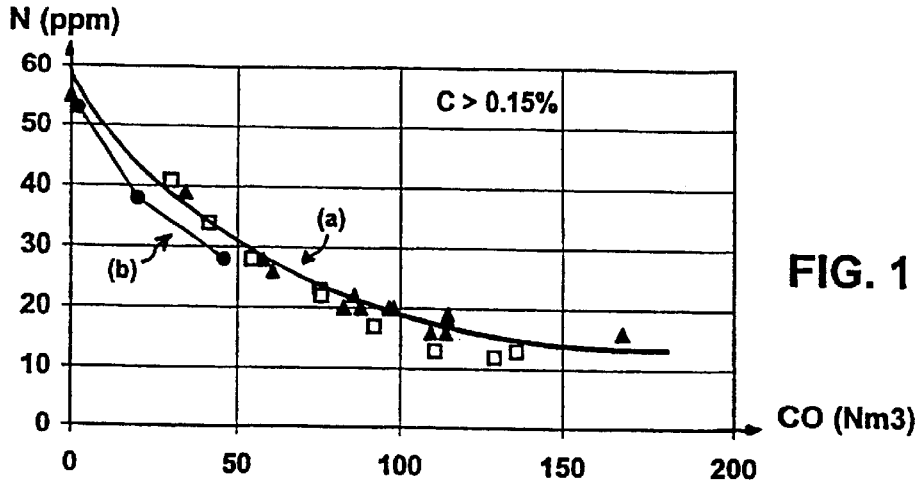
FIG. 1 is a graph showing the compared evolution of the content by weight of nitrogen in a steel bath in the electric oven containing more than 0.15% of carbon by weight, as a function of the volume of CO emitted in the bath, from a single injection of oxygen (curve a) and from a carbon-oxygen co-injection according to the invention (curve b).
Figure 2:
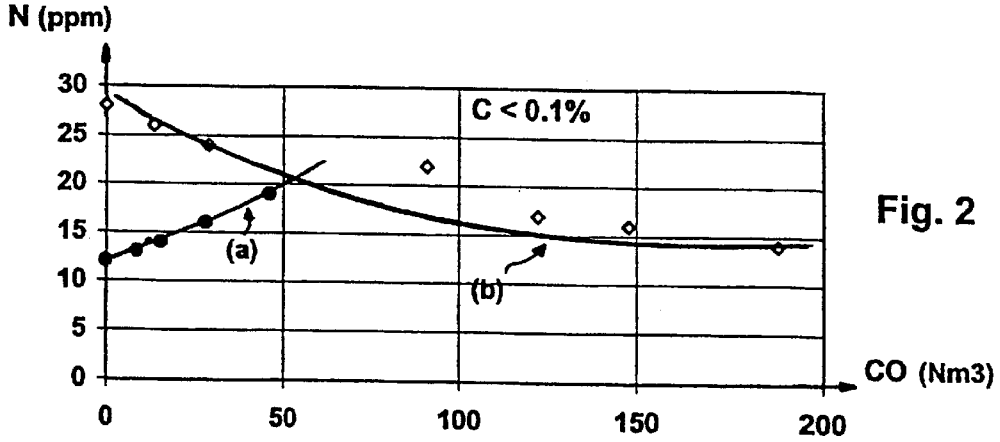
FIG. 2 is a graph similar to that of the preceding Figure, but on decarburized bath, i.e. in the case of the content by weight of carbon of the metal bath being low, namely less than 0.1%.

The quantitative results obtained are firstly those presented in FIGS. 1 and 2 where the co-injection of carbon and oxygen (curve b) is compared with a simple decarburization (curve a) and this by representing the evolution of the nitrogen content of the metal as a function of the volume of CO emitted in the bath, for a steel respectively with more than 0.15% of carbon (FIG. 1) and with less than 0.10% (FIG. 2).

As may be seen, for steels which are relatively barely decarburized, the content of dissolved $O_2$ is always too low to be able to block the diffusion of the dissolved nitrogen towards the bubbles of washing gas, and this whether it be CO of decarburization of the bath (curve a) or CO generated by reaction between the carbon and the oxygen introduced to the bath according to the invention (curve b). In effect, a quite similar course is observed of these two denitriding kinetic curves, moreover close to each other, given as a function of the accumulated quantity of CO which is released from the bath with time, while a slightly better efficiency, of the order of 5 ppm, may be noted in favour of the mixed injection according to the invention.

On the other hand, for decarburized or low-carbon steels—of which the boundary will be set at 0.10% by weight to fix ideas, as it is known that below that threshold it is no longer possible to denitride by the simple usual method of decarburization—, it is observed in FIG. 3 that the kinetics of denitriding in the case of co-injection (curve b) has the same course as in the preceding case and that it is therefore independent of the initial carbon content of the bath. On the other hand, in the conventional case of mono-injection of $O_2$ alone (curve a), a systematic regain of nitrogen is observed which increases regularly all along the emission of the CO of decarburization. This phenomenon of nitrogen regain which, as already explained hereinbefore, is the resultant of two mechanisms acting simultaneously but in opposite directions, clearly shows that, in the case of the low-carbons, the denitriding by the CO of decarburization is blocked by the local formation, in the vicinity of the gas bubbles, of high-activity oxidized phases and that consequently the regains of atmospheric nitrogen are the dominant mechanism, all the more powerful, moreover, as the surface of the bath is in that case stirred by the bubbles which burst there (curve a). On the contrary, following the example of what curve b of FIG. 1 shows, in the case of co-injection according to the invention (curve b of FIG. 2), the dominant mechanism is always that of the denitriding by the washing CO, independently of the initial content of carbon, therefore even for very low carbons.

Figure 3:
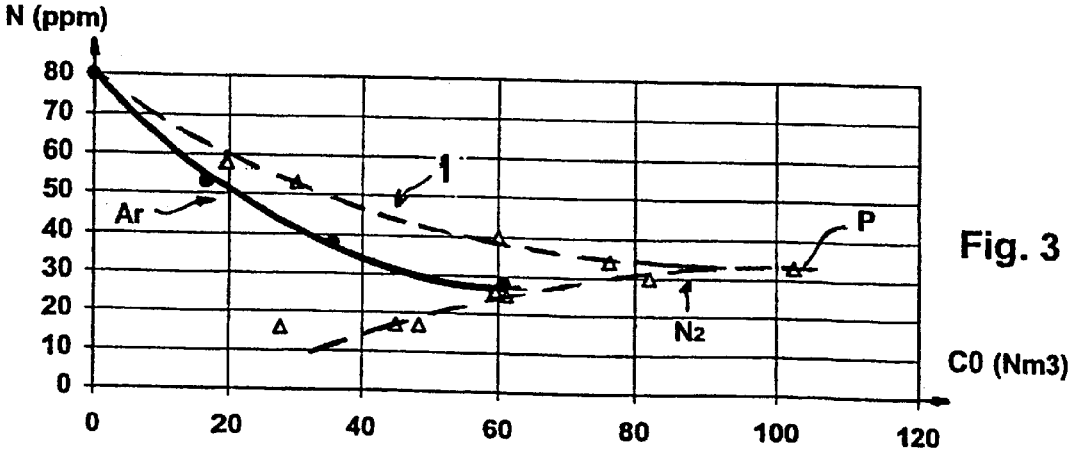
FIG. 3 is a graph showing the compared evolution of the content by weight of nitrogen as a function of the volume of CO emitted in the bath by carbon-oxygen co-injection depending on the nature of the gas and of transport of the carbon injected.

The influence of the carbon transporting gas on the results obtained is given in FIG. 3. It shows that, with an injection of the coal under a flow of nitrogen (curve I), the kinetics of denitriding is slower and leads to a limited nitrogen content of the metal (plateau p) below which one cannot access, higher than in the case of an injection under a flow of argon. Nonetheless, it is possible to obtain a denitriding in that case, which may be compatible with a "mean" objective on the content of nitrogen envisaged (plateau p at 35 ppm in the present case, for example).

The method of dinitriding of the invention proves to be sufficiently supple to implement in order to allow multiple variant embodiments, of which some examples are mentioned hereinafter:

Use of any Type of Carbon and Oxygen Input

In effect, any oxidising gas or any oxidising powder (iron ore, but also manganese ore, silica powder, etc . . . ) may in effect be used as supplier of oxygen. Similarly, any type of carbon-containing product may be used for introducing carbon.

It is also possible to use products containing these two elements at the same time, for which the local input is in that case effected in known manner by automatized means, and even mixtures prepared in advance (coal/iron ore mixture for example).

Use of any Input Technology Eensuring the "Local" Conditions Envisaged here

Conventional injection nozzles, cooled or not, may in effect be used; immersed parietal nozzles or any other form of injectors, whether they be of the type "with separate injections" for oxygen and carbon, or of the type with "single injection", with concentric, or adjacent, tubes.

Use of this Technique in any Type of Metallurgical Reactor

The co-injection according to the invention may be practised without particular difficulties in the electric oven, but also in the converter with blowing of $O_2$ from the top (type LD, AOD) or from the bottom (type OBM, LWS); in the pocket oven or in the installations in vacuo, type RH, where one can, in addition, benefit from the effect of the vacuum on the denitriding ($P_{N2}$ weak above the metal bath).

Modification of the Carbon/oxygen Ratio with Respect to the Stoichiometry

The advantage of adjusting the inputs of $O_2$ and of C with respect to the stoichiometry was seen previously. As will be understood, it is therefore also possible to maintain dinitriding conditions in the nozzle, while slightly modifying this cabon/oxygen ratio, in order for example to continue a decarburization of the metal at the same time as the denitriding phase takes place.

The following will be noted in particular among the outstanding advantages of the invention:

The possibility of Nitridino with low Carbon Contents

Due to the modification of the local conditions (carbon content, activity in dissolved oxygen), this technique makes it possible, as has been seen, to denitride the metal while the mean content of carbon in the metal bath is less than 0.1% (limit below which one no longer dinitrides with a simple decarburization). Phases of dinitriding by emission of CO with "constant carbon content of the bath" were thus able to be carried out for a mean carbon content of the bath included between 0.05 and 0.1% by weight.

The Easy and Supple Implementation of the Method

The technique does not necessitate heavy investment. In the case of the electric oven, in particular, the necessary installations are generally already available in the factory, namely: a network for input of oxygen coupled to a device for injection in the metal (ordinarily already present for the decarburization), and a powder dispenser associated with a device for injecting the coal in the metal (generally already present for the injection of coal in the slag). This latter device must nonetheless be divided if it is desired to effect a simultaneous injection of carbon and of oxygen in the metal, while a foaming slag on the metal bath is developed at the same time. In the case of the other production reactors, it may be necessary to provide a device for introducing carbon in the same zone as the oxygen injected.

The cost of the practice of this nitriding technique is in that case summarized as that of the consumables: products for input of carbon and oxygen, and transport gas in the case of an injection of solid products.

A Possible Denitriding in "Masked Time"

This technique may be particularly interesting in the case of an electric oven with double-vat, where the phase of denitriding by simultaneous input of carbon and oxygen may be effected in masked time during the melting of a fresh metal load in the other vat made live. To that end, the operation of denitriding will be effected at the end of production of a load, without electrical voltage, the electrical power being transferred on the other vat for the melting of the following load, without loss of productivity for the steelworks.

It goes without saying that the method according to the invention may present multiple equivalent or variant embodiments insofar as its definition given in the accompanying claims is respected.

What is claimed is:

1. Method for denitriding of a bath of molten steel during its production comprising the steps of introducing oxygen in the bath, and also in introducing in said bath, carbon in a form-capable of being blown, said carbon and oxygen being injected simultaneously but separately, side by side, in the same zone of the metal bath.

2. Method according to claim 1, wherein the inputs of carbon and of oxygen are adjusted in stoichiometric manner.

3. Method according to claim 1, wherein the carbon is injected in the powdery solid state with the aid of a transport gas.

4. Method according to claim 1, wherein it is carried out in an electrical steelworks installation with double vat.

* * * * *